US005259425A

United States Patent [19]

Johnson et al.

[11] Patent Number: 5,259,425

[45] Date of Patent: Nov. 9, 1993

[54] METHOD AND APPARATUS FOR DENSIFYING FLEXIBLE BULK CONTAINERS

[75] Inventors: Ronald D. Johnson, Leawood, Kans.; Kelly L. Twogood, Lee's Summit, Mo.

[73] Assignee: United States Systems, Inc., Kansas City, Kans.

[21] Appl. No.: 710,497

[22] Filed: Jun. 5, 1991

[51] Int. Cl.[5] ..... B65B 1/20

[52] U.S. Cl. ..... 141/12; 141/10; 141/73; 141/76; 141/80; 141/83; 100/281; 100/915; 177/DIG. 11; 366/108; 366/141

[58] Field of Search ..... 141/10-12, 141/83, 69, 114, 71, 73-77, 80, 128; 366/141, 240, 108, 110-112, 124, 208; 177/DIG. 11, 145, 146; 100/281, 915

[56] References Cited

U.S. PATENT DOCUMENTS

| | | | |
|---|---|---|---|
| D. 315,627 | 3/1991 | DeCrane | D34/38 |
| 77,374 | 4/1868 | Hewitt | 366/141 |
| 733,449 | 7/1903 | Willsie | 141/75 |
| 915,847 | 3/1909 | Frye | 141/75 |
| 1,110,087 | 9/1914 | Wagner et al. | 100/915 X |
| 1,583,875 | 5/1926 | Grono | 141/74 X |
| 1,852,376 | 4/1932 | Rees | 141/75 X |
| 2,622,780 | 12/1952 | Ackerman | 141/76 |
| 2,795,990 | 6/1957 | Bohlman et al. | 141/74 X |
| 3,083,780 | 4/1963 | Swenson | 141/83 X |
| 3,200,859 | 8/1965 | Parker, Jr. | 141/73 |
| 3,376,905 | 4/1968 | Lau | 141/76 |
| 3,805,905 | 4/1974 | McClusky | 177/DIG. 11 X |
| 4,273,738 | 6/1981 | Spengler | 100/214 X |
| 4,319,652 | 3/1982 | Guertin | 177/255 |
| 4,526,095 | 7/1985 | Rewitzer | 141/80 X |
| 4,696,357 | 9/1987 | Beehler et al. | 177/DIG. 11 X |
| 4,718,464 | 1/1988 | Delves et al. | 141/75 |
| 4,804,550 | 2/1989 | Bardsley et al. | 141/74 X |
| 4,854,353 | 8/1989 | Russell | 141/74 |
| 5,036,893 | 8/1991 | DeCrane | 141/114 |

FOREIGN PATENT DOCUMENTS

| | | | |
|---|---|---|---|
| 0542183 | 8/1922 | France | 141/80 |
| 0142800 | 1/1921 | United Kingdom | 141/73 |
| 0406084 | 2/1934 | United Kingdom | 141/74 |
| 0448710 | 6/1936 | United Kingdom | 141/80 |
| 0490973 | 8/1938 | United Kingdom | 141/80 |

OTHER PUBLICATIONS

"Powder Handling & Processing", International Journal of Storing, Handling & Processing Powder, vol. 1 No. 4, Nov. 1989, pp. 420-421.

"Powder & Bulk Engineering" vol. 3 No. 5, May 1989, pp. 26, 46-54, 57-62, 67, 121 and 127.

"Equipment in Semi-Bulk (IBC) Filling" by Custom Equipment Design, Inc. Undated.

*Primary Examiner*—Henry J. Recla

*Assistant Examiner*—Casey Jacyna

*Attorney, Agent, or Firm*—Hovey, Williams, Timmons & Collins

[57] ABSTRACT

A method and apparatus for densifying a flexible bulk container with dry or semi-moist flowable material broadly includes a method and apparatus whereby the container and its contents are relatively gradually lifted and then relatively rapidly dropped onto a stop member such as an impact anvil, serving to densify the material contents of the container, or by alternatively compressing the contents thereof for maximum concentration of the container's contents. The apparatus broadly includes a frame which is positioned on top of a load cell or other weighing apparatus, a container supporting member such as a deck, and an impact member such as a post which serves to isolate the load cell from the impact of the container on the impact member. The filling apparatus is constructed whereby the contents of the container may be weighed during densification thereof so that the container may be rapidly and accurately filled without the need to remove it for weighing or to interrupt the densification process. In addition, the apparatus hereof is configured to compress the contents of the container whereby the material contents in the upper portion of the container will be satisfactorily densified. The invention also includes methods for densifying the material, for continuous weighing of the container during densification and for further densification of the material contents by compressing the container within the frame.

14 Claims, 3 Drawing Sheets

METHOD AND APPARATUS FOR DENSIFYING FLEXIBLE BULK CONTAINERS

BACKGROUND OF THE INVENTION

1. Field of the Invention

This invention concerns an apparatus for filling flexible bulk containers. The contents of the container are relatively slowly raised and then relatively rapidly impacted or dropped quickly to densify the contents thereof. Alternatively or in addition, the apparatus provides for compressing the container to increase the density of the contents. The method and apparatus hereof enables the container contents to be continuously weighed during densification and compaction.

2. Description of the Prior Art

One method of storing and distributing bulk materials involves the use of flexible intermediate bulk containers, hereinafter referred to as FIBCs. FIBCs are typically used to contain dry or semi-moist flowable bulk material therein and are provided with a woven polypropylene, normally air permeable fabric outer layer. The FIBCs are typically rectangular in configuration and are provided with four lifting loops at the top corners. An inlet spout for filling the contents of the FIBC is located at the center of the top wall thereof and configured to fit around a material inlet of a filling machine. The FIBC may also be provided with an air-tight polyethylene liner. Many different types of material may be contained by these large bag-like FIBCs such as, e.g., cement, kaolinite, talc, and plastic pellets. Thus, it may be appreciated that FIBCs can be used to carry a wide variety of loose, substantially dry bulk material, and typically the FIBCs have a capacity of one to three tons.

The material contained in the FIBCs is typically sold by weight, and thus during filling of the FIBCs with the bulk material, there is a need to weigh the contents to ensure an accurate amount of bulk material is received within the bag. Concomitantly, there is a need to ensure that each bag contains a maximum volume of the material, not only for efficient utilization of the space within the FIBC, but also to enable each FIBC to stack more easily with greater stability and to ensure efficient utilization of warehouse and transport vehicle space.

To this end, apparatus has been developed to densify the contents of an FIBC. That is to say, densifying apparatus has been developed to "pre-settle" the contents of the FIBC and thus minimize wasted space in the interstices between the particles of the bulk material. These prior art devices have often rapidly agitated or vibrated the contents of the container. While this accomplished densification to a certain degree, it also was largely inefficient in that it tended to re-suspend or "re-loosen" the contents during the rapid upward movement of the container.

Another problem which has been encountered is the inability to obtain optimum densification of particularly light, fluffy materials, such as, e.g., kaolinite. While conventional densification has moderately improved the density of such materials at or near the bottom of the container, the lightweight material at the top of the container has remained loose. There has thus developed a need to further densify containers carrying such loose, fluffy materials therein.

There thus remains a need for an apparatus which will more efficiently densify the contents of the FIBC, which will accomplish densification more quickly, and which will reduce the overall time needed to fill, weigh and densify the FIBC so that the entire process may be expedited, thus improving productivity.

SUMMARY OF THE INVENTION

The present invention largely solves these problems by providing a method and apparatus for filling, weighing and densifying a flexible container with flowable bulk material. By densifying, it is to be understood that this term includes both a settling of the container contents to ensure settling of the material in the container to optimize the ratio between the material and the available volume within the container, and also to include compression of the container and its contents whereby gas occupying the interstices between the particles of the material is driven out of the container as the material is compressed.

The settling effect is uniquely accomplished in the present invention by relatively slowly lifting the container and its contents and thereafter rapidly dropping and impacting the same onto a stop or impact anvil. The slow lifting prevents the agitation and re-loosening effect on the material contents of the container described above, so that the density of the material increases each time the container and its contents move downwardly to impact. The relatively slow lifting and rapid dropping of the container effectively onto an impact device thus contrasts with conventional agitation-type densifiers which shake and reloosen the contents during the upward stroke. In accordance with the preferred embodiment of the present invention, the lift and drop cycle would not occur more rapidly than about once a second and more typically about once every three seconds. The amount of lift and concomitant drop may be varied according to the particular material involved, and the process may be repeated through a number of lift and drop cycles to obtained the desired amount of densification.

Another benefit of the method and apparatus of the present invention resides in its ability to weigh the container during the densification process whereby the amount of the material in the container may be monitored during filling. Thus, it is not necessary to interrupt the filling process in order to ascertain the weight of material resting within the container. This result is accomplished by the apparatus herein whereby the container, its material contents and the frame which supports the filling apparatus and carries the container is supported on load cells associated with the base of the apparatus. The bottom of the container rests on and is thus supported by a deck which is shiftable in a generally up and down direction relative to the frame. At least one impact anvil is positioned beneath the deck to engage the latter at the end of the downward movement thereof. The impact anvil is located to isolate the load cell against damage during impact, but upon subsequent lifting of the deck, the load cell is again in operative relationship relative to the deck and the container positioned thereon, whereby the weight of the contents may again be ascertained. During repeated upward lifting of the deck and container, and subsequently toward a downward impact on the impact anvil, the weight of the contents resting in the container are determined, whereby the weight thereof may be determined substantially continuously during the filling process.

The apparatus hereof may also include apparatus which enables compression of the contents of the container to further densify material therein. To accomplish this purpose, the apparatus includes structure which supports the bottom of the container thereon and opposing engagement member such as a grid or the like, as well as means for decreasing the relative distance between the two. This may include a lifting apparatus associated with the deck, or might in fact be accomplished by, for example, telescoping the framework to decrease the distance between the deck and the engagement member. In either event, the engagement member, which is preferably positioned adjacent the material inlet introducing the material into the container, prevents the top of the container from moving upwardly and thus serves to compress the material contents of the container. The container is preferably of a woven construction whereby the air or other gas therein is free to escape through the container side and top walls. This apparatus serves to increase the density of the contents in the upper portion of the container, which portion is less subject to the densification process described in the preceding paragraph.

In particularly preferred forms, the apparatus hereof includes a cut-off valve associated with the material inlet which, when the relative distance between the supporting member and engagement member is reduced, closes off the material inlet to prevent the escape of the material contents therethrough. The inlet is preferably of a double-wall construction and an annular space is provided between the inner and outer circumference walls. The annular space serves to enable air to flow into the container and thus inflate it, making the container ready for receipt of material throughout substantially the entire volume thereof. In addition, when the container is compressed, air may flow through the annular space to escape from the container.

Another preferred aspect of the present invention involves a leveling device associated with the deck and the frame. The deck is preferably lifted at the center thereof by, for example, an inflatable bellows, although a set of rams, cams, or other motive means could be located at the corners of the support structure in substitution. Springs are disposed between the deck and the frame to compensate for shifting of the material to a center of gravity which is offset relative to the bellows or other lifting device. The springs thus bias the deck to a generally horizontal, neutral position.

The invention hereof also includes a method for densifying the material contents of the container while filling and weighing the same. In this regard, the method is particularly efficient in that it allows the weight of the container to be continuously monitored through intermittent weighing of the contents as the container is lifted, and then densified by a downward movement effectively impacting the container. These steps may be repeated during the filling process so that a sequence of weights may be obtained to determine when the material inlet should be closed. Preferably, the inlet will be closed prior to reaching the desired net weight of the contents of the container, so that a dribble valve or the like may introduce the balance of the material necessary to bring the container up to an exact, final weight. In accordance with this method, and depending upon the availability of material to be introduced into the container, a flexible intermediate bulk container having a capacity of e.g., 1 ton, may be filled and densified to a final weight in less than a minute.

Another associated method of the present invention involves compressing the contents of a bulk container by first filling the container to a portion of the desired amount, reducing the distance between a container supporting surface and an engagement member, compressing the container to increase the density of the material contents by exhausting air therefrom, and then introducing additional material into the container. The compression may be accomplished by an extensible structure associated with the apparatus described hereinabove, or alternatively may be accomplished by, for example, telescoping the upper and lower portions of the frame of the apparatus together. The method hereof may also include providing a negative source of pressure adjacent the exterior of the container to receive particulate matter expelled through the container during compression and transport the latter to an environmentally safe, remote site.

Accordingly, the present invention advantageously provides for efficient use of flexible bulk containers by ensuring the maximum amount of material is contained therewithin, and enables rapid filling of the same. Further details and objects of the present invention will be readily appreciated by those skilled in the art by reference to the following description and the drawings submitted therewith.

DESCRIPTION OF THE PREFERRED EMBODIMENT

Figure 4:
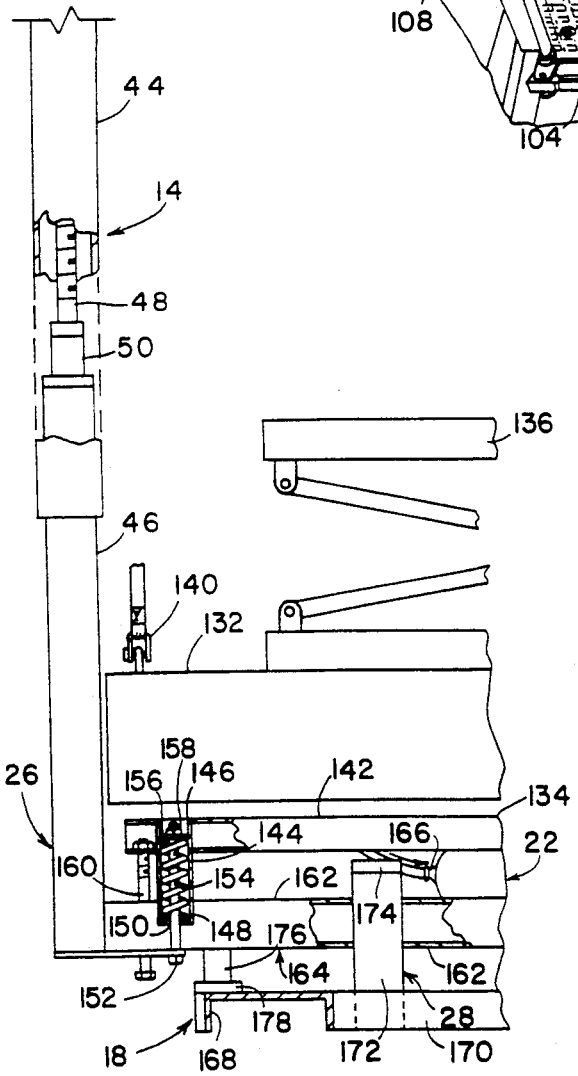
FIG. 4 is an enlarged fragmentary front elevational view of the invention hereof showing the impact anvil, inflatable bellows, and leveling device, together with the telescoping device associated with the frame.

Referring now to the drawing, an apparatus for filling flexible bulk containers is broadly designated by the reference character 10 and includes a control station 12, a frame 14, support structure 16, a base 18, bulk material feeding apparatus 20 and a motive member 22 for raising and lowering the support structure 16 relative to the frame 14, best seen in FIG. 4. Frame 14 includes a tower 24 telescopically connected to a lower footing 26, base 18 receives a plurality of impact anvils 28 thereon, one of said anvils being shown in FIG. 4.

In greater detail, control station 12 includes a digital readout 30 for displaying the weight of the contents of a container 32, which is preferably a flexible intermediate bulk container having a capacity of from 1 to 5 tons, although it is to be understood that containers of other sizes could be accommodated in accordance with the teachings of the present invention. Control station 12 also includes a plurality of switches 34 for manually controlling various aspects of the operation of the apparatus 10 hereof. The control station includes a programmable controller for automatically regulating the operating devices such as the motive means 22, feed valve 36 which includes a dribble valve, an inflation fan 38, and inflatable cuff 40 having a neoprene sleeve which serves to hold the container spout 42 in position on the apparatus 10. One such programmable controller found to be useful in accordance with the present invention Allen Bradley Model SLC 500, available from Rensen House Supply, of Kansas City, Mo. A feed valve 36 found useful in accordance with the present invention is the Dezurik Series L 8-inch knife gate valve available from Flowquip Controls of Tulsa, Okla.

Figure 2:
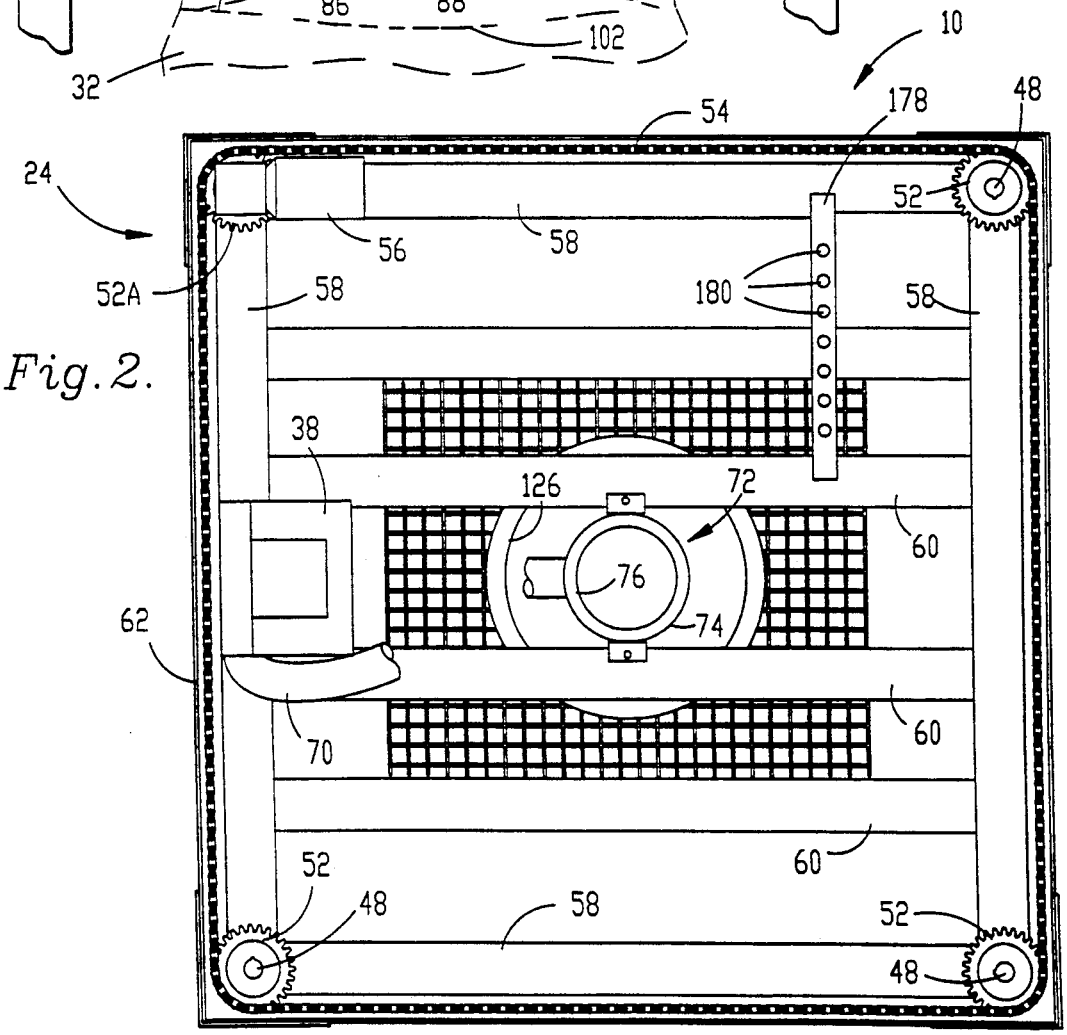
FIG. 2 is a top plan view of the present invention with portions of the air conduit removed for clarity, showing the material inlet and surrounding grid for engaging the top of the container.

As noted earlier, frame 14 includes tower 24 which is located at the upper portion of the frame and includes four downwardly depending legs 44 which telescopically receive upwardly extending arms 46 of lowermost footing portion 26 therewithin. As shown in FIG. 4, an all-thread rod 48 is received within the tubular legs 44 and threadably received within an Acme nut 50 affixed to the uppermost portion of each arm 46. A sprocket 52 is affixed to each all-thread rod 48 at the uppermost portion of the latter. A drive chain 54 is engaged with each of the sprockets 52. Motor 56 drives one of the sprockets 52A, as shown in FIG. 2, whereby the remaining sprockets 52 may be simultaneously driven by the chain 54 to rotate the rods 48 in unison. Four tubular beams 58 and cross ribs 60, together with upwardly oriented rail 62, are mounted on legs 44 as part of the tower 24.

Figure 1:
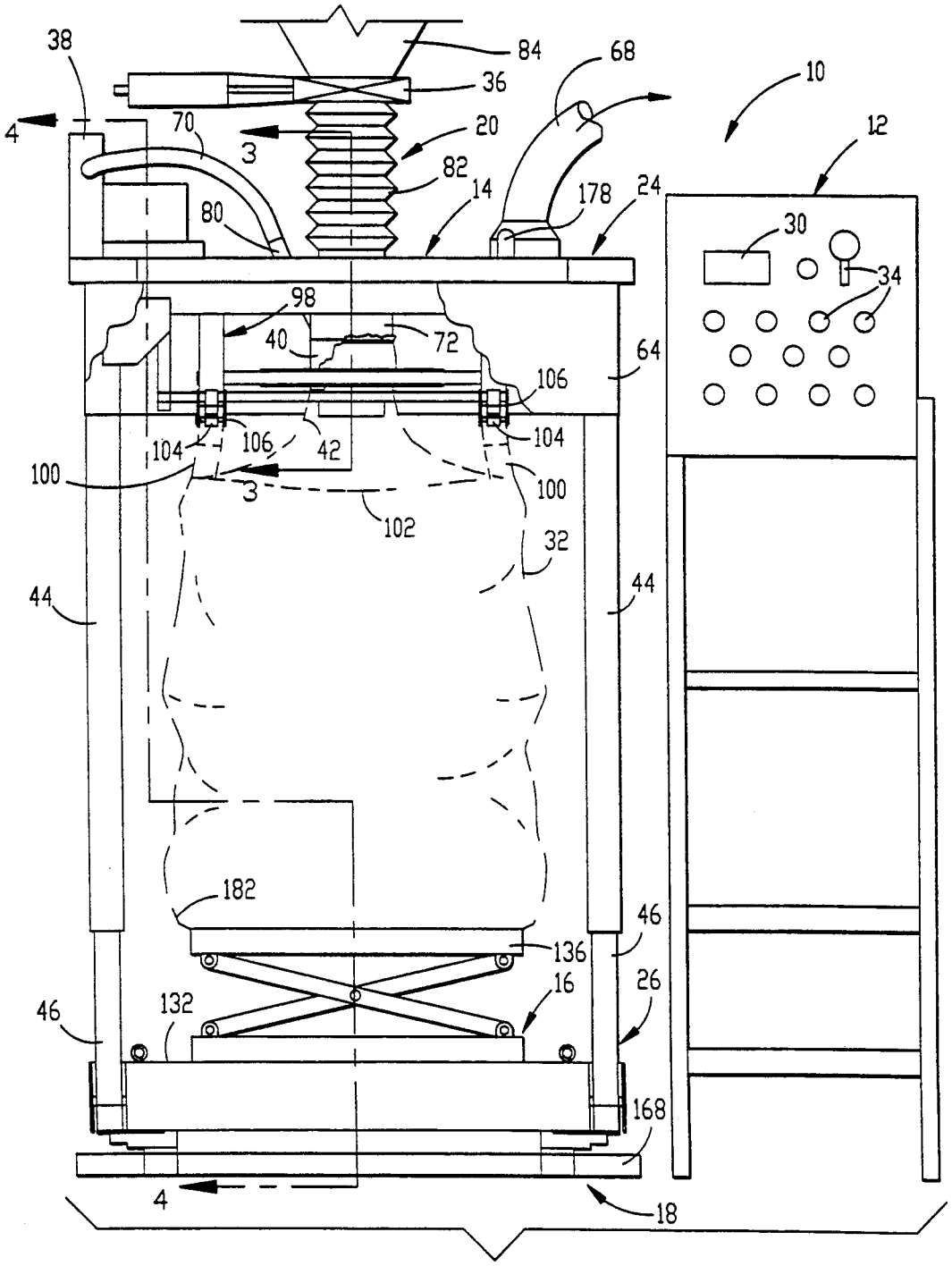
FIG. 1 is a front elevational view of the present invention with portions broken away for clarity, showing the apparatus for filling, densifying and weighing flexible bulk containers, including an associated control station.

A hood 64 substantially encloses the top of the tower 24 for capturing particulate matter expelled through the container 32 during compression of the latter. The hood 64 includes an opening so that bulk material falling through feeding apparatus 20 may pass therethrough, and also defines a plurality of ports 66 positioned radially outwardly of the feeding apparatus 20. Each of the ports 66 is operatively connected to a vacuum source by a hose 68, one of which is shown in FIG. 1, but it is to be understood that others are to be provided at the other three ports 66.

Figure 3:
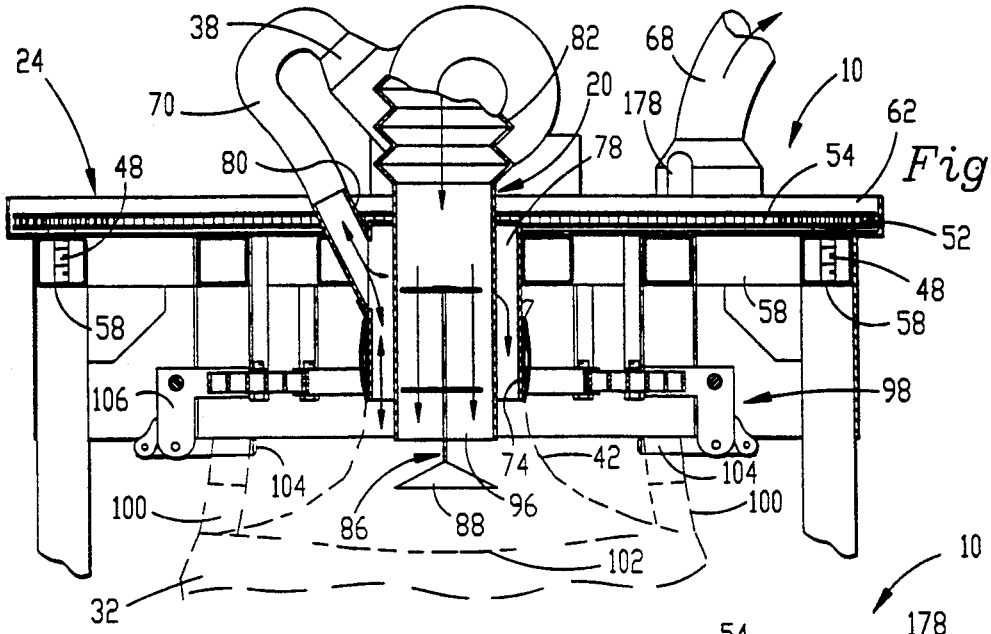
FIG. 3 is a fragmentary vertical cross-section view along Line 3—3 of FIG. 1, illustrating the upper portion of the frame and the material inlet including the cut-off valve for engaging the material contents of the container.

Inflation fan 38 is mounted atop tower 24 and supplies air through conduit 70 to material inlet 72. An inflation fan found useful herewith is a Dayton Blower Model 4C329 available from W. W. Grainger, Inc. of Kansas City, Mo. As shown in FIG. 3, material inlet 72 includes a cylindrical outer wall 74 and a concentric inner cylindrical wall 78 defining an annular space 78 therebetween. Air supplied by inflation fan 38 passes through conduit 70 and into a Y-connector 80 fluidically connected to annular space 72 where the pressurized air is then forced into container 32 for inflating the latter.

Material inlet 72 is connected to feed valve 36 at its uppermost margin by a flexible, extendable corrugated chute 82. It may be appreciated that the telescopic relationship between tower 24 and footing 26 enables height adjustment of the frame 14. Because material inlet valve 36 is ordinarily fixed in relationship to a funnel 84 or other supply of bulk material, chute 82 must be able to expand or collapse in order to accommodate different heights of the tower 24 portion of the frame 14.

A cut-off valve 86 is mounted interiorly of material inlet 72 and includes a normally conical plug 88 connected at the lower end of strut 90. Strut 90 is shiftably mounted by cradle 92 and is provided with a stop 94 which prevents strut 90 from dropping through cradle 92. Plug 88 is sized to extend completely across material passageway 96 defined within the cylindrical inner wall 76. Thus, upon engagement by the bottom surface of plug 88 with the bulk material contents of the container 32, plug 88 and strut 90 are able to ride upwardly until plug 88 blocks material passageway 96.

Figure 5:
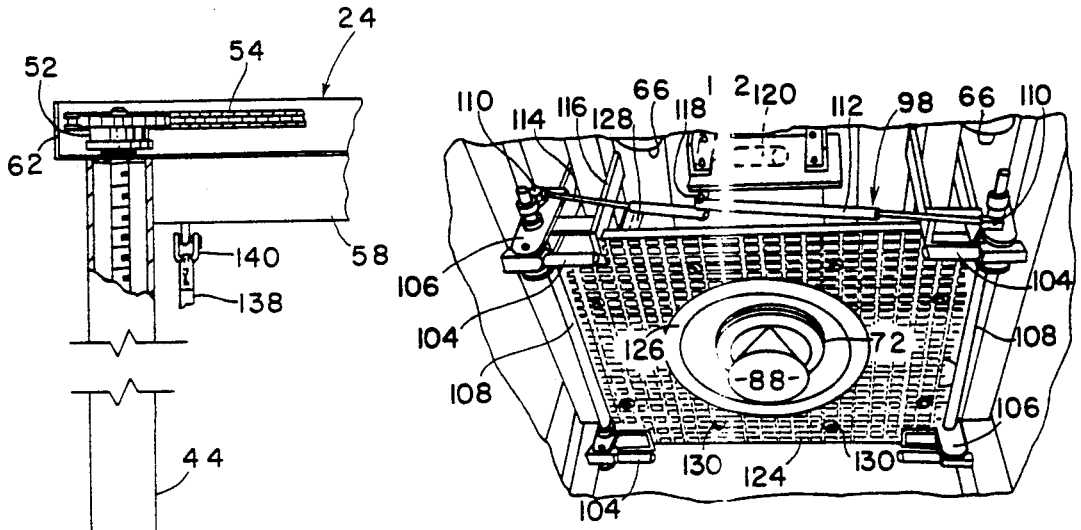
FIG. 5 is a fragmentary perspective view looking upwardly toward the material inlet and the grid illustrating the retaining fingers for carrying loops disposed around the top of the container.

Tower 24 also mounts thereon a container release apparatus 98. The container release apparatus 98 is designed to carry the container 32 which includes four loops 100 located at the peripheral corners of the top wall 102 of the container 32. Container 32 is thus able to hang from the container release apparatus 98 during filling, densifying and weighing of the contents thereof. Container release apparatus 98 includes four latches 104 each adapted to receive a loop of the container thereon and are pivotally mounted to release brackets 106. As best seen in FIG. 5, the latches 104 are positioned in opposed pairs, each opposed pair connected by a shaft 108, and each of the shafts 108 being provided with a crank arm 110 which are interconnected by links 112 and 114. Opposed to each of the latches 104 is a tab 116 of ultra-high molecular weight polyethylene whereby loops supported by the latches 104 may be retained in position until the latches 104 are rotated by shafts 108. The links 112 and 114 are interconnected by a pin 118 and are actuated by a double acting air cylinder 120 (shown in phantom), such as Humphrey Air Cylinder Model 3DP4 available from Skarda Equipment Co. of Omaha, Nebr. Actuation of the air cylinder 120 to retract shaft 122 thereof serves to pivot the latches 104 to a downward orientation, thereby releasing the loops 100.

Grid 124 presents a substantially planer lower surface and is provided with a plurality of perforations for passage of air therethrough during compression of the container 32. Grid 124 is disposed in substantially surrounding relationship to material inlet 72, but the inner circular margin 126 of the grid 124 is spaced radially outwardly of the material inlet 72 to present an opening and allow attachment of the spout 42 of the container 32 around the inflatable cuff 40. Grid 124 is preferably sized to engage substantially the entire top wall 102 of the container 32 when the distance between the support structure 16 and the grid 124 is reduced to place the contents of the container 32 is compression. Grid 124 is preferably spaced downwardly from the top of the hood 64 by angle irons 128 connected by transversely extending angle irons (not shown), whereby the grid 124 is secured to the transversely extending angle irons by bolts 130 at eight different locations as may be seen in FIG. 5.

Supporting structure 16 includes a deck 132 and a cross frame 134, and may also include in preferred embodiments, a scissors lift 136. Deck 132 presents a substantially planer upper surface and conventionally rests on cross frame 134. However, when access is desired to cross frame 134 for such purposes as maintenance and the like, a lifting strap 138 may be connected between the deck 132 and beams 58 of tower 24 by a clevises 140 as may be seen in FIG. 4. The deck may then be lifted off the cross frame 134 by actuating the sprockets 52 and the all-thread rod 48 to telescope the tower 24 upwardly relative to the footing 26.

Scissors lift 136 is positioned on top of deck 132 when it is desired to compress the material contents of the container 32. Other lifting mechanisms may be employed, but an economical and effective unit found useful in connection with the present invention Bishamon Scissors Lift Model X-300 available from McMaster Carr Supply of Chicago, Ill. This lift is provided with an electric motor whereby the lift 136 may be extended or retracted. Cross frame 134 is provided in the shape of a cross when viewed from the top and includes four outwardly extending spokes 142. Each spoke is provided at the outward end thereof with a tubular cylindrical spring pocket 144. The spring pocket is provided with an open upper margin 146 and a substantially closed lower margin 148 is provided with a hole 150 at the center thereof for receiving therethrough a carriage bolt 152. A spring 154 is positioned within each spring pocket 144. A spring found useful in providing the appropriate resiliency to accomplish leveling of off-center loads is a heavy duty die spring of 1¼ inch diameter by 6 inches high available from the Bossart Co. of Kansas City, Mo. An annular retainer 156 is secured to the upper portion of bolt 152 by a nut 158 whereby upward movement of the lower margin 148 of spring pocket 144 will compress the spring 154. Located radially outward from spring pocket 144 on each spoke 142 is retaining bolt 160 which extends through the spoke and through square tubular member 162 which, together with square tubular cross channels (not shown) extending between tubular members 162 and underneath motive member 22, comprise an underpinning structure 164 of footing 26 for limiting the upward movement of the cross frame 134 by motive member 22.

Motive member 22 is located between underpinning structure 164 and cross frame 134. In the preferred embodiment, a Firestone Air Bag Model W 01 358-8152 available from Skarda Equipment Co. of Omaha, Nebr. is utilized as an inflatable bellows, although it is to be understood that the raising and lowering of the support structure 16 accomplished thereby to densify the contents of the container could be accomplished by other devices such as, for example, hydraulic rams, rotatable cams located at the corners of the support structure 16, and the like. The air bag shown herein is provided with a quick exhaust of the air contained therein whereby relatively rapid dropping of the container 32 may be accomplished. The air bag, serving as the motive member 22, includes a connector 166 for attachment to a source of compressed air as shown in FIG. 4.

Base 18 includes a pair of transversely extending channel members 168 welded to a pair of longitudinally extending channel members 170. Channel members 168 are oriented with their open end facing downwardly and are spaced apart preferably corresponding to the width of the forks of a forklift. The open end of channel members 170 are oriented facing upwardly to receive thereon impact anvils 28. FIG. 4 illustrates one impact anvil 28, but it is to be understood that four such impact anvils 28 are preferably provided at spaced locations radially outward from motive member 22. Each impact anvil 28 is preferably in the form of a tubular steel post 172 and is provided at the top thereof with a ½ inch thick bumper 174 of resilient material of synthetic resin material such as polyurethane. The bumper 174 serves both to limit the bounce of the support structure 16 and container 32 which would otherwise occur in a metal to metal contact, and also provide a sound deadening function. The bumper 174 serves to provide a positive stop and limit agitation of the contents of the container 32 after impact.

Base 18 also includes preferably four load cells 176 positioned on mounting brackets 178 which extend upwardly from channel members 168. A satisfactory load cell 176 for use in the present invention is a Cardinal SB 2500S available from Cardinal Manufacturing of Joplin, Mo. Each of the four load cells is connected to an electronic scale which may be located in the control station 12, and a Cardinal Dominator 738 from Cardinal Manufacturing has been found to be compatible with the present invention. The load cells 176 are positioned on top of mounting brackets 178 whereby they may weigh the frame 14, support structure 16, motive member 22, container 32 and its bulk material contents. However, when motive member 22 is not extended and the support structure 16 shifts downwardly, the container 32 and the material contents thereof, together with the support structure 16, rests on top of the impact anvils 172, and in this circumstance the impact anvils 172 isolate the load cells from the support structure 16, container 32 and its contents from any impact and also from any weighing relationship with respect thereto.

In an alternative embodiment of the present invention, it may be desirable to omit the grid 124 when compressing of the material contents of the container 32 is not desired. In this eventuality, it may be possible to slidably mount the release brackets 106 relative to one another within each pair by rollers positioned along the top of cross ribs 60. In this circumstance, an air cylinder may be provided to shift one bracket 106 of each pair closer to the other bracket 106 along each shaft 108 for ease in affixing the loops 100 to the latches 104. For ease in accomplishing this result, a pneumatic cylinder may be used to automatically shift the brackets in closer proximity, and Advanced Automation Air Cylinder Model B 240 X 17 DC available from Skarda Equipment Co. of Omaha, Nebr., has been found useful in this regard.

The principal operating components of the present invention are pneumatically operated. In this regard, a pneumatic solenoid bank 179 receives a source of compressed air from a compressor or compressed air tank and distributes the air through respective ports 180 for each of the operating components such as the air cylinder 120, the motive member 22, feed valve 36 and cuff 40. The solenoid bank 179 is operatively controlled by the programmable controller located in control station 12. A solenoid bank 179 found useful in connection herewith is a Humphrey 4-way valve Model T 125 4E 1 36-120-60 available from Skarda Equipment Co. of Omaha, Nebr.

Other equipment may be associated with the present invention for ease of use. For example, the container 32 may be mounted on a pallet. In addition, a conveyor may be mounted on the deck 132 or the scissors lift 136 so that the container and/or pallet may be rolled off the deck or scissors lift and a new container installed in place. In any event, the addition of different auxiliary items does not affect the filling, densifying and weighing of the container and its contents, as the apparatus 10 hereof is able to compensate for differences in height and initial weight prior to filling.

In accordance with the method of using the apparatus 10 hereof, the apparatus 10 is first connected to a power source and a source of compressed air, preferably providing pressure in the range of 90 to 120 pounds per square inch. A container 32 is then mounted on the feeding apparatus 20 by attaching the loops 100 of the container 32 to the latches 104 and affixing the spout 42 around the material inlet 72 and inflating the cuff 40 to hold the spout 42 in position and effect a positive seal around the material inlet 72. Additionally, drawstrings may be provided with the spout and drawn tight to resist any slippage of the spout. If the height of tower 24 needs to be raised to accommodate a particular size of container 32, the operator can actuate a switch to operate the drive motor 56 and thereby raise or lower the tower 24 relative to the footing 26.

The operator then tares out the apparatus whereby the weight to be measured and displayed by the load cells and associated scale is only the material which will flow into and rest within the container 32. It is thus understood that while the weight of the container 32 and the components of the apparatus 10 above the base 18 is detected by the load cells and associated scale, the actual weight displayed will only be the net weight of the material resting within the container 32.

The operator also sets the desired height to which the support structure 16 will be raised and lowered during the densifying process. Conventionally, this will be in the range of one or two inches, although this may be adjusted according to the particular material in the container 32. The operator also sets the desired duration of the lift and drop of the support structure and consequently, the container 32 and its contents. For example, the number of cycles of lifting and dropping may vary from 10 to 150 cycles per minute, although it is preferable to operate within the lower end of this range for most materials. Typically the lifting of the support structure 16, including the deck 132, cross-frame 142, and scissors lift 136 (if used), would last about 0.7 seconds, the dropping portion of the cycle would take about 0.1 second, and then there would be a delay of about 2 or 3 seconds before another cycle began.

With knowledge of the ultimate net weight of the container and contents, the operator also sets a cut-off set point where the feed valve 36 will cut off the continuous flow of material into the container 32. The set point is determined according to the type of material and how fast it feeds into the container 32, so that for a one-ton net weight container, the set point 32 may be from, e.g., 1600 to 1950 pounds, although other set points are certainly well within the capabilities of the apparatus and method hereof. After the set point has been reached, the feed valve 36 enters a dribble flow mode which is conventionally slower than the initial fill rate. It is to be understood that the apparatus 10 hereof can substantially continuously monitor, on an intermittent basis, the weight of the material contents resting in the container 32, but cannot measure the material still falling from the feed valve 36. It is for this reason that a set point less than the final desired weight is employed.

The operator is then ready to begin operation of the apparatus by opening the feed valve 36 so that flowable bulk material can fall into the container 32. As material begins to accumulate on the bottom 182 of the container 32, the densification process begins automatically as the motive member 22 (in this embodiment an air bag which inflates) raises the support structure 16. When the support structure, including the deck 132 and the cross member 142, and the container 32 and its material contents is raised to the desired height, the air in the motive member is rapidly exhausted and the support structure then drops whereby the container 32 resting thereon is brought into effective engagement with the bumper 174 of the impact anvil 172. The support structure 16 ensures that the impact generated thereby is solidly distributed to the bottom 182 of the container 32 and thus to the material therein.

During lifting of the support structure, the container 32 is out of functional engagement with the impact anvil 172 and thus the load cells may determine the weight of the material contents of the container. Thus, the weight of the material resting on the bottom of the container 32 is continuously measured and displayed on the digital readout 30 of the control station 20, interrupted only when the support structure 16 and the container 32 are functionally supported by the impact anvil 172. The lifting and dropping steps comprising the densification cycle are then repeated as the container fills with the bulk material until the set point is reached.

At the set point or any point therealong, the operator may elect to compress the container 32 to further densify the material therein. This is ordinarily done at or after the set point is reached so that the maximum benefit can be obtained, as it is the uppermost material, e.g. the last material flowing into the container 32, which is the most difficult to densify by the lifting and impacting process. In the preferred method, the operator actuates the scissors lift 136 which elevates the container 32 until the material in the container 32 engages the grid 124. During this process, the plug 88 is raised by its engagement with the material in the container, whereby the material passageway 96 is closed. The scissors lift 136 exerts further pressure against the bottom of the container 32, which serves to expel air in the interstices between the material and exhaust it through the woven outer surface of the container. If compression of the material is to be performed, an airtight liner would not be included as part of the container 32. While some air may be expelled through the sides of the container, most of the expelled air passes through the container at or near the top wall 102, and through the spout 42, and out through annular space 78. Should any fine particulate matter pass through the top wall 102, it is contained by hood 64 and suctioned into hose 68 for collection. As noted hereinabove, instead of employing a scissors lift or other lifting mechanism, the telescoping feature, whereby the height of the tower and the footing may be adjusted, could be used to compress the container between the grid 124 and the deck 132. When the material is satisfactorily compressed, the scissors lift is lowered and the container 32 returned to its initial position with the plug 88 again lowering to open the material passageway.

The material in the container will then be densified to the extent that some additional volume will be available inside the container. To that end, the value 36 functions as a dribble valve to add additional material at a slower rate until the desired final weight is achieved. After this latter dribble phase, additional densification may take place by lifting and dropping the container, until a final, densified material is contained by the container 32. The container 32 is then ready to be transported. The cuff 40 is deflated and the spout 42 is detached from the material inlet. If the container is on a pallet, a fork lift may easily pick up the pallet and container, or if the container 32 is on a conveyor, it may be passed therealong for further processing.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of their invention as pertains to any apparatus not materially departing from but outside the liberal scope of the invention as set out in the following claims.

We claim:

1. In densifying apparatus for use during filling of a flexible container with flowable bulk material, the improvement comprising:

a support disposed to underlie the bottom of the container as it is being filled with material;

a power device operably coupled with the support for intermittently raising the support through a short, vertical lift stroke and then suddenly dropping the support through a short, vertical drop stroke;

means for limiting the support to a rectilinear path of travel as it moves through its lift strokes and drop strokes whereby to avoid shaking the container and its contents from side-to-side; and a stop disposed within the path of travel of said support during its drop stroke for causing the support to abruptly impact the stop at the end of the drop stroke and thereby jar the material within the flexible container into a more densified condition, said support and said power device being carried on a common frame, said stop being located out of load-transferring relationship with the frame; and weighing means operably coupled in load-bearing relationship with said frame for determining the weight of the container and its contents during the lift stroke of the support when the support is off the stop.

2. In a densifying apparatus as claimed in claim 1, said weighing means comprising a load cell.

3. In a densifying apparatus as claimed in claim 2, said apparatus further including a base spaced below the frame, said load cell projecting upwardly from the base into supporting relationship with the frame, and the stop projecting upwardly from the base into position for impact engagement by the support at the end of its drop stroke, said stop being out of engagement with said frame.

4. In densifying apparatus for use during filling of a flexible container with flowable bulk material, the improvement comprising:

a support disposed to underlie the bottom of the container as it is being filled with material;

a power device operably coupled with the support for intermittently raising the support through a short, vertical lift stroke and then suddenly dropping the support through a short, vertical drop stroke;

means for limiting the support to a rectilinear path of travel as it moves through its lift strokes and drop strokes whereby to avoid shaking the container and its contents from side-to-side; and a stop disposed within the path of travel of said support during its drop stroke for causing the support to abruptly impact the stop at the end of the drop stroke and thereby jar the material within the flexible container into a more densified condition, said apparatus further including an overhead backstop above the container and in vertically spaced opposition to the support, said support including an actuatable lift portion for periodically pressing the container upwardly against the backstop to further densify the contents.

5. In a densifying apparatus as claimed in claim 4, said lift portion of the support including an extendable and retractable scissor linkage.

6. In densifying apparatus for use during filling of a flexible container with flowable bulk material, the improvement comprising:

a support disposed to underlie the bottom of the container as it is being filled with material;

a power device operably coupled with the support for intermittently raising the support through a short, vertical lift stroke and then suddenly dropping the support through a short, vertical drop stroke;

means for limiting the support to a rectilinear path of travel as it moves through its lift strokes and drop strokes whereby to avoid shaking the container and its contents from side-to-side; and a stop disposed within the path of travel of said support during its drop stroke for causing the support to abruptly impact the stop at the end of the drop stroke and thereby jar the material within the flexible container into a more densified condition, said power device including an inflatable bellows.

7. In densifying apparatus for use during filling of a flexible container with flowable bulk material, the improvement comprising:

a main frame;

a support movably mounted on the frame for supporting the load of the container as it is being filled;

a power device between the frame and the support for intermittently raising the support through a short lift stroke and then suddenly dropping the support through a short drop stroke;

a stop disposed within the path of travel of the support during its drop stroke but located out of load-bearing relationship with the frame for causing the support to abruptly impact the stop at the end of the drop stroke and thereby jar the material within the container into a more densified condition; and weighing means coupled in load-bearing relationship with said frame but out of load-transferring relationship with the stop for determining the weight of the container and its contents during the lift stroke of the support when the support is raised off the stop.

8. In densifying apparatus as claimed in claim 7, said weighing means comprising a load cell.

9. In a densifying apparatus as claimed in claim 8, said apparatus further including a base spaced below the frame, said load cell projecting upwardly from the base into supporting relationship with the frame, and the stop projecting upwardly from the base into position for impact engagement by the support at the end of its drop stroke, said stop being out of engagement with said frame.

10. A method for use in densifying the material contents of a flexible bulk container including the steps of:

lifting the container from the bottom thereof into a raised position;

suddenly removing the lifting force from the bottom of the container and allowing the container to drop a short distance onto a solid stop, whereby to abruptly impact the container and densify the contents;

confining the container to a vertical path of travel during lifting, dropping and impacting thereof whereby to prevent side-to-side agitation and shaking of the contents of the container; and weighing the container as it is being lifted but not while it is resting on the stop, said lifting step being carried out by resting the container on a vertically reciprocable support which is carried during the lifting movement by a stationary frame, said weighing step being carried out by determining the loading on the frame during the lifting movement of the support.

11. A method as claimed in claim 10, said step of determining the loading on the frame being carried out using a load cell.

12. A method for use in determining the weight of the contents of a flexible container during non-stop filling of the container and densification of the contents by periodically raising the container through a short lift stroke and then suddenly dropping of the container through a short drop stroke onto a fixed stop, said method including the steps of:

moving the container through its lift strokes and its drop strokes while the container is resting upon a support that is carried by a stationary frame;

positioning the stop so that it is impacted by the support without transferring the impact load to the frame; and determining the loading on the frame during the lift stroke of the support by using weighing means coupled with the frame and isolated from the stop.

13. A method as claimed in claim 12, said step of determining the loading on the frame being carried out using a load cell.

14. A method as claimed in claimed 12, said support being confined to a vertical path of travel during lifting, dropping and impacting thereof.

* * * * *